US007841957B1

(12) United States Patent
Wares

(10) Patent No.: US 7,841,957 B1
(45) Date of Patent: Nov. 30, 2010

(54) BASKETBALL RETURN APPARATUS WITH TRACK EXTENDER AND DEFLECTOR

(76) Inventor: Jonathan G. Wares, 2110 W. 31st St., Los Angeles, CA (US) 90018

( * ) Notice: Subject to any disclaimer, the term of this patent is extended or adjusted under 35 U.S.C. 154(b) by 0 days.

(21) Appl. No.: 12/387,972

(22) Filed: May 11, 2009

(51) Int. Cl.
*A63B 69/00* (2006.01)

(52) U.S. Cl. ..... 473/433; 473/447

(58) Field of Classification Search ..... 273/394–397, 273/431–435, 447–450, 479–489
See application file for complete search history.

(56) References Cited

U.S. PATENT DOCUMENTS

| | | | | | |
|---|---|---|---|---|---|
| 1,765,269 | A | | 6/1930 | Hatley | |
| 3,233,896 | A | | 2/1966 | King | |
| 3,776,550 | A | | 12/1973 | McNabb | |
| 3,814,421 | A | | 6/1974 | Spier, Jr. | |
| 3,901,506 | A | | 8/1975 | Caveney | |
| 3,917,263 | A | | 11/1975 | Wiley | |
| 4,291,885 | A | | 9/1981 | Cohen | |
| 4,579,339 | A | | 4/1986 | Grimm | |
| 4,579,340 | A | | 4/1986 | Jenkins et al. | |
| 4,667,957 | A | | 5/1987 | Joseph | |
| 4,678,189 | A | | 7/1987 | Koss | |
| 4,697,810 | A | | 10/1987 | Mathison | |
| 4,706,954 | A | * | 11/1987 | Kershaw | 473/434 |
| 4,714,248 | A | | 12/1987 | Koss | |
| 4,720,101 | A | | 1/1988 | Farkas | |
| 4,869,502 | A | | 9/1989 | Wares | |
| 4,896,882 | A | | 1/1990 | Coleman | |
| 4,913,431 | A | * | 4/1990 | Jakobs | 473/433 |
| 4,936,577 | A | * | 6/1990 | Kington et al. | 473/433 |
| 4,940,231 | A | * | 7/1990 | Ehler | 473/431 |
| 4,957,289 | A | * | 9/1990 | Kotlarz | 473/433 |
| 5,016,875 | A | * | 5/1991 | Joseph | 473/433 |
| 5,165,680 | A | * | 11/1992 | Cass | 473/433 |
| 5,184,814 | A | | 2/1993 | Manning | |
| 5,265,870 | A | | 11/1993 | Merino | |
| 5,273,275 | A | * | 12/1993 | Wilkerson | 473/433 |
| 5,312,099 | A | * | 5/1994 | Oliver, Sr. | 473/433 |
| 5,333,853 | A | * | 8/1994 | Hektor | 473/433 |
| 5,348,290 | A | | 9/1994 | Matherne | |
| 5,382,017 | A | | 1/1995 | Pippert | |
| 5,393,049 | A | * | 2/1995 | Nelson | 473/433 |
| 5,409,211 | A | * | 4/1995 | Adamek | 473/433 |

(Continued)

OTHER PUBLICATIONS

Notification of Transmittal of the International Search Report and The Written Opinion of the International Searching Authority, or the Declaration, Form PCT/ISA/220, mailed Jul. 30, 2010; PCT/US10/01326 (International Filing Date: May 5, 2010).

*Primary Examiner*—Mark S Graham
(74) *Attorney, Agent, or Firm*—Ian C. McLeod; Steven M. Parks

(57) ABSTRACT

The present disclosure provides for a foldable, portable, apparatus for use as an operant conditioning basketball shooting practice aid by retrieving and returning shots at the hoop. The apparatus is comprised of a dismountable trough assembly depending from crossbar slots of a support assembly frame. The trough assembly includes ball collection panels each mounted on separated ball runway tubes or rails with the legs of a track extender-deflector inserted into the tubes. The deflectors are adapted to be configured for quick interchangeability from one configuration to another to deliver the ball to various locations to center or side court.

22 Claims, 4 Drawing Sheets

U.S. PATENT DOCUMENTS

| | | | | |
|---|---|---|---|---|
| 5,540,428 | A * | 7/1996 | Joseph | 473/433 |
| 5,556,106 | A * | 9/1996 | Jurcisin | 473/431 |
| 5,676,293 | A | 10/1997 | Farris | |
| 5,746,668 | A * | 5/1998 | Ochs | 473/433 |
| 5,779,569 | A | 7/1998 | Townsend | |
| 5,803,837 | A * | 9/1998 | LoFaso, Sr. | 473/433 |
| 6,048,029 | A | 4/2000 | Percoco | |
| 6,056,652 | A * | 5/2000 | Lees et al. | 473/433 |
| 6,267,696 | B1 * | 7/2001 | Mabe et al. | 473/433 |
| 6,458,049 | B2 * | 10/2002 | Bush | 473/433 |
| 6,752,728 | B1 * | 6/2004 | Tien | 473/433 |
| 6,811,500 | B2 | 11/2004 | Tien | |
| 7,201,676 | B2 | 4/2007 | Rumfola, III | |
| 7,510,492 | B2 | 3/2009 | Hudson | |
| 2001/0055999 | A1 * | 12/2001 | Bush | 473/433 |
| 2006/0003855 | A1 * | 1/2006 | Kershaw | 473/433 |
| 2007/0037638 | A1 * | 2/2007 | Rumfola | 473/433 |
| 2009/0203472 | A1 * | 8/2009 | Snyder | 473/433 |
| 2010/0113189 | A1 * | 5/2010 | Blair | 473/433 |

* cited by examiner 101
101A
102
103
104
100
200
DDL
SDL
ND

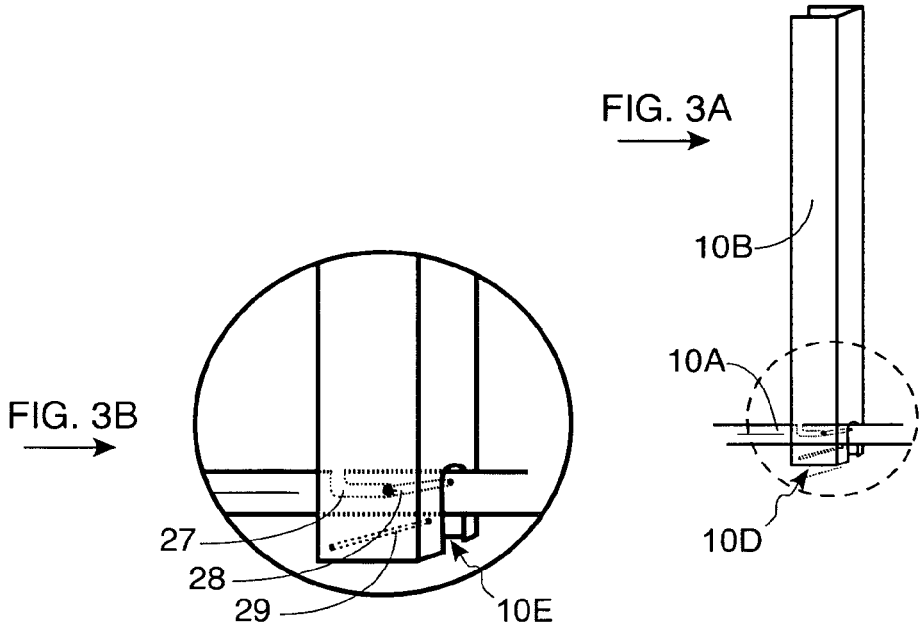
FIG. 3A
10B
10A
10D
FIG. 3B
27
28
29
10E
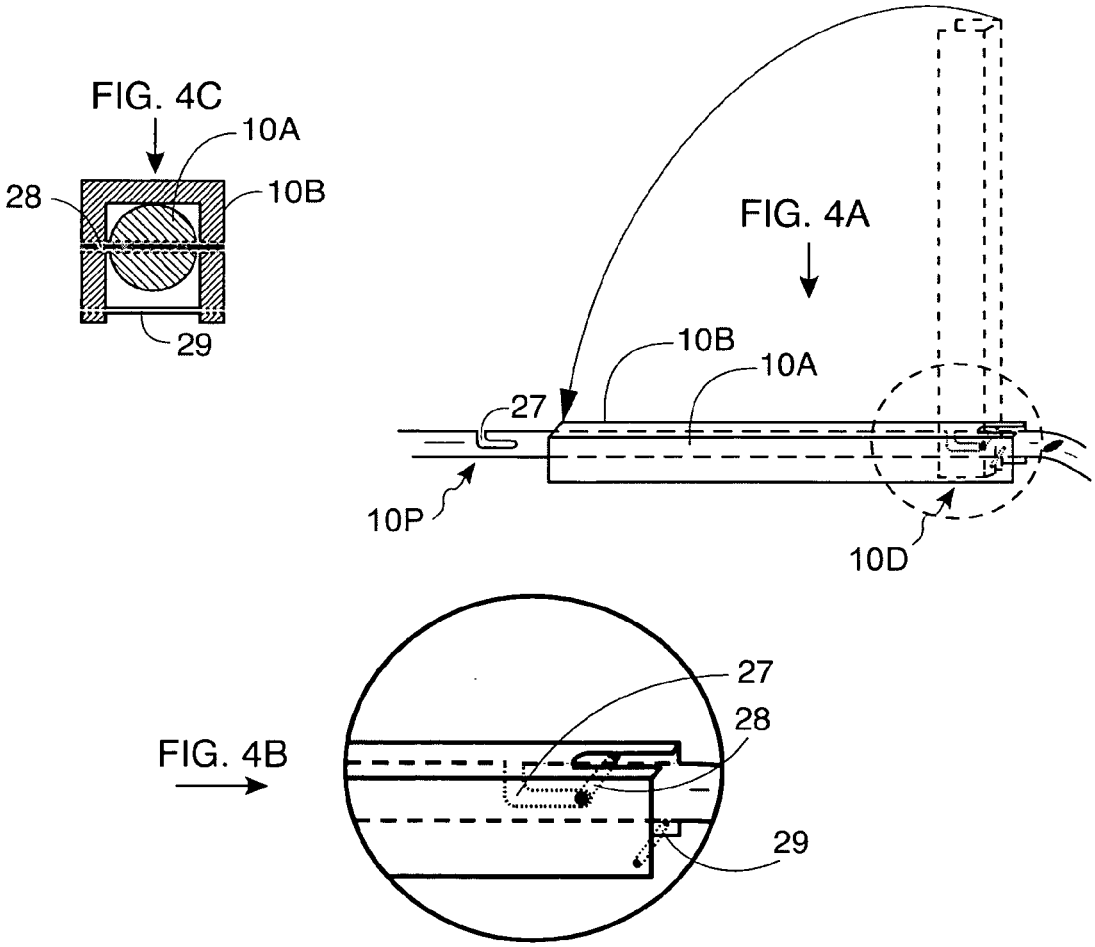
FIG. 4C
10A
28
10B
29
FIG. 4A
10B
10A
27
10P
10D
FIG. 4B
27
28
29

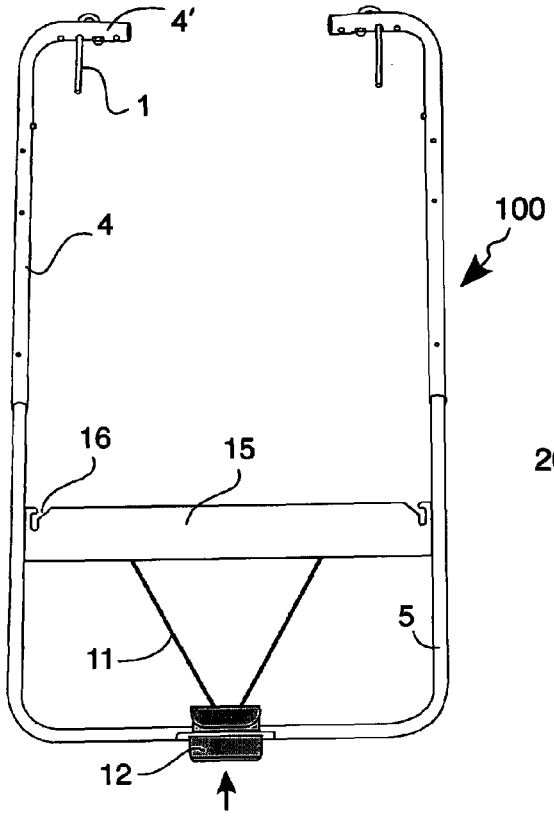
FIG 5A
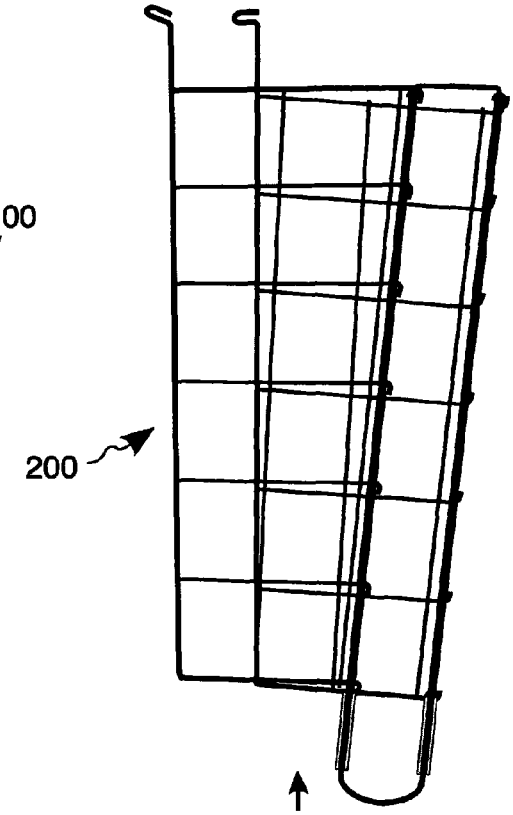
FIG 5B
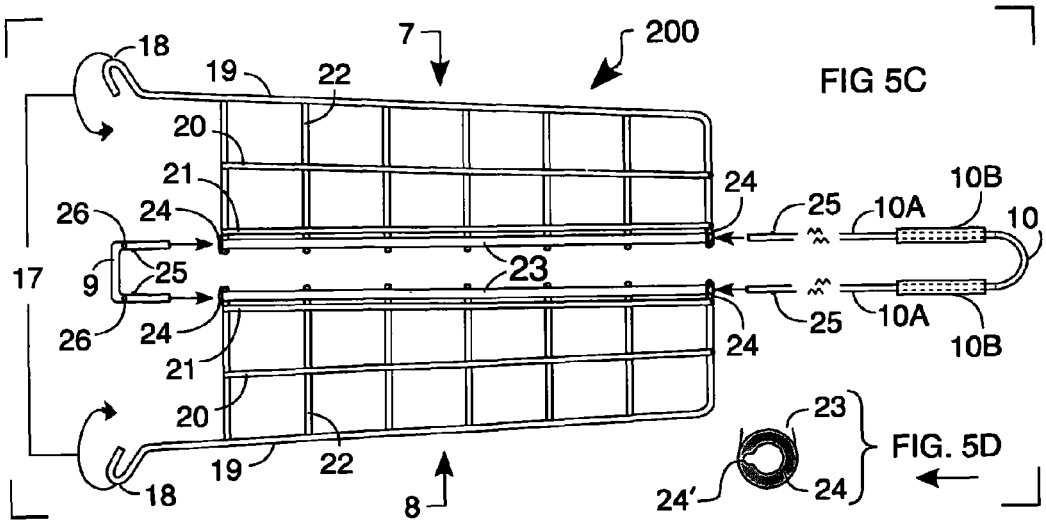
FIG 5C
FIG. 5D

BASKETBALL RETURN APPARATUS WITH TRACK EXTENDER AND DEFLECTOR

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION (1) Field of the Invention

The present invention relates generally to basketball training devices, especially to a basketball return apparatus for use by a player in practicing field goal and free-throw shooting to improve shooting accuracy ultimately measured by a player's scoring percentage and the ability to return the ball to various locations on the court.

(2) Description of Related Art

Many, if not most basketball players prefer to remain at one position at a time on the court during shooting practice. This is not due to athletic indolence but is a result of rather sound judgment about what is required of performance setting events in order to learn reliable shooting habits.

For a player's acquiring the motor skill of basketball shooting accuracy, what is required for most efficient response acquisition would be the maintenance of relatively constant performance setting events during what is essentially a trial and error process of learning a perceptual motor skill congruently involving the coordination of body, mind, and spirit in the rhythm of shooting.

Ideally, for most efficient habit formation, a ball should be returned to a player in a reliably similar manner which minimizes events setting up a player's extraneous arrhythmic motions such as bending, stretching, stumbling, or chasing for the ball and maximizes events setting up his shot oriented rhythm of catching, aiming, and shooting the ball.

Heretofore, a variety of basketball returns or ball retrieval devices have been proposed and implemented for redepositing a basketball with a player.

One such apparatus, as disclosed in U.S. Pat. No. 4,579,340 to Jenkins et al., comprises a vertically extending chute projecting upwardly from the base, positioned on the floor, for receiving balls, and a horizontal ball collection and dispersion tube, with a power-operated plunger mounted in the base swinging about a vertical axis, for receiving and directing balls to various on-court locations. There are problems because of the limitation imposed by the apparatus requiring an external power supply, not easily accessible indoors without additional equipment such as power extension cables with the appropriate type of plug for an available electrical outlet, and typically useless outdoors where such outlets are normally unavailable without provision of additional equipment such as a gas-powered electrical generator and fuel to power it. Without use of a truck, users have the added problems of how to transport and where to store such a large type of apparatus when not in use. The device is also expensive.

Another simpler apparatus is disclosed in U.S. Pat. No. 3,814,421 to Spier, Jr. and includes a lightweight chute with a curved body portion of substantially shape-retentive flexible material nesting in a circumferentially notched ring and angularly adjustable by fitting its mating tooth into different notches of the ring which is attached to the backboard or suspended by hooks from the hoop. As with other apparatus of the type which depend from the hoop, there are problems with the deviation in the regulation size foramen of the hoop as a consequence of attachment of the apparatus's hooking members. No longer are users assured that the encumbered goal assembly will respond in a normal manner to the impact of a ball striking it. Attachment to the backboard, while resolving this problem, leaves users with the prospect of having to alter the integrity of the backboard in an adaptive way to accommodate the attachment means of the apparatus. Yet another problem is that, even when attached to the backboard, the user's view of the hoop and net is substantially obscured by the apparatus, again resulting in the goal assembly being significantly altered in its standard appearance as a regulation goal.

More significantly, users of the Spier device have a problem with the fixed lateral run such apparatus afford the ball whereby its momentum can deliver it with similar efficiency only to a fixed range of different positions on court. While in position to utilize the apparatus near the goal, players find it impossible to take shots from positions progressively farther from the goal without equally progressive loss of the apparatus's efficiency returning the ball. Thus, a player stepping back to shoot from a somewhat further position experiences increasingly inconvenient setting events in terms of the speed and height of the ball's delivery.

Yet another lightweight apparatus is disclosed in U.S. Pat. No. 3,901,506 to Caveney and includes a main back frame which is detachably mountable onto a backboard of predetermined vertical dimension and having a pair of side frames outfolding to a position both normal to the main back frame and above and below and alongside the hoop. Flexible netting chute means covers the frames and extends downwardly to attach to means flush with a user's feet on the floor for returning the ball to a player at the free-throw line.

The Caveney apparatus also has problems with accommodability, enabling use only with a backboard of predetermined vertical and thickness dimension, and lacking ease of mountability on the variety of different popular backboards having various other measures of these dimensions particularly the goal support assemblies to which they are attached.

Another limitation of the Caveney apparatus is that the ball is deliverable only to a player on the straightaway from goal to foul line and positions on right and left court are without delivery service. In addition, during normal use of the apparatus, with both side panels typically outfolded for free-throw shooting, a user desiring to practice shooting from substantially right or left court finds both his view and the ball's access path to the goal substantially limited.

More importantly, the Caveney apparatus delivers the ball at the player's feet, rolling rather than bouncing it to a player standing at or beyond the foul line. This setting event necessitates the player bending over and stretching down each time the ball returns to pick it up. Straightening up to resume his normal shooting stance, the player then has to reset himself to restart his shooting rhythm for the next shot. Players, accustomed to receiving the ball in the course of the game on a vigorous bounce, have a problem with the setting event of receiving a ball on a roll because it causes an interruption of their shooting stance with each practice trial and never allow them to establish a shooting rhythm catching, aiming and shooting the ball.

It is an established principle of the psychology of motor skill learning that response acquisition is enhanced to the extent that performance setting events are similar from trial to trial during practice. Most players, therefore, would find it desirable to have a training device which would facilitate this learning principle and could deliver the ball to a player in a reliably similar, efficient, and convenient fashion.

Other patents of interest are: U.S. Pat. Nos. 1,765,269 to Hatley; 3,917,263 to Wiley; 4,579,339 to Grimm; 4,291,885 to Cohen; 4,720,101 to Farkas; 4,697,810 to Mathison; 4,706,954 to Kershaw; 4,714,248 to Koss; 4,678,189 to Koss; 3,233,896 to King; 4,667,957 to Joseph; and 3,776,550 to McNabb.

OBJECTS

It is therefore an object of the present invention to provide a basketball retrieving apparatus which can be adjusted to be easily mounted and demounted from a conventional basketball backboard, regardless of the thickness of the backboard including any thickness added by the goal support assembly to which the backboard is mounted. It is further an object to provide a ball retriever apparatus adaptable to backboards varying in their vertical dimension. Further still, it is an object to provide a ball retriever which can be characterized in that the hoop and net of the goal assembly on which it is mounted is free from any and all encumbrances by the retriever apparatus, thereby ensuring the hoop and net being free to respond normally to the impact of the ball and presenting, for and during optimal use of the retriever, a substantially clear viewing path to the hoop and net from locations on-court circumscribed by a 180° arc in front of and alongside the backboard. Further, it is an object to provide a ball retriever apparatus with rigid ball collection and return means which guide a ball, including a missed shot entering said return in front of the goal, speedily downward by means of an extensible track which redeposits the basketball on a vigorous bounce to a player for a variable range of different locations. Further still, it is an object to provide a ball retriever apparatus with alternative, left and right court oriented track extender deflectors which can deliver the ball to other positions on court than those at a point perpendicular to and in the front and center of the goal. Also it is an object to provide a ball retriever which can allow players to stand beneath it close to the hoop to set up for practicing hook shots after receiving the ball directly from the apparatus. Further still, it is an object to provide a ball retriever apparatus designed for ease of assembly, adjustment, attachment, and detachment. The retriever apparatus is constructed so that it may be readily set up for use and as readily broken down and nested for transportation in which significant parts are hinged or telescoped together so that they may be folded and compressed into a compact substantially flat package for transport.

These and other objects will become increasingly apparent by reference to the following description.

SUMMARY OF THE INVENTION

The present disclosure provides for an apparatus for mounting onto a support for use in retrieving a basketball passing through or shot at a hoop. The apparatus comprises: (a) a trough assembly comprised of a pair of spaced apart rails defining a proximal end for mounting on a support means and a distal end for ball delivery to a user, wherein the trough assembly is mounted to be angled substantially downward from the proximal end to the distal end to allow the ball to roll down the rails; (b) an extender mounted at the distal end of the rails having a pair of legs defining a proximal end and a distal end; and (c) a pair of deflector members, one mounted on each leg of the extender, wherein each deflector member is adapted to lie flat for direct ball delivery or rotate upward, at either the proximal end or distal end of the extender, to be positioned substantially perpendicular to the rails. In a particular embodiment, each leg of the extender defines at least one slot for receiving a deflector to allow for rotation upward of the deflector about the slot. In a further embodiment, each deflector comprises an orientation pin that slides into the slot for rotation of the deflector upward about the slot. In an even further embodiment, each leg of the extender defines a plurality of slots.

The present invention further provides for an apparatus for retrieving a basketball after it passes through a hoop mounted on a backboard having a top side, an opposed bottom side, and vertical sides between the top side and the bottom side. The apparatus comprises: (a) a support assembly comprised of (i) holding means for removably mounting on the top side of the backboard, (ii) a first horizontally oriented crossbar below the hoop, and (iii) a spaced apart second horizontally oriented crossbar vertically positioned between the first crossbar and the hoop; (b) a trough mounted on or against the first crossbar so as to be cantilevered from the first crossbar, the trough comprising spaced apart parallel rails each having opposed proximal and distal ends along axis defined by the rails and connecting the rails together wherein the proximal end is adapted to be removably mounted on or against the first crossbar; (c) a pair of spaced apart panels having proximal and distal ends mounted on opposite rails so that a portion of the panels adjacent to each rail extends below the axis of rail, wherein the basketball rides on the rails without riding on the portions of the panels adjacent to the rails so that the basketball is returned by the trough with a minimal rolling resistance to the ball; (d) mounting means on the proximal end of each panel for removably mounting the panels on the second crossbar to form a generally syncline, V-configuration, of the pair of panels with the rail; and (e) an extender mounted at the distal end of the rails having a pair of deflector members adapted to lie flat to allow for (i) direct ball delivery, or (ii) positioned substantially perpendicular to the axis of the rails for right side ball delivery, or for left side ball delivery.

The present disclosure further provides for an apparatus for retrieving a basketball after it passes through a hoop mounted on a backboard having a top side, an opposed bottom side, and vertical sides between the top side and the bottom side. The apparatus comprises: (a) a support assembly comprised of a pair of spaced apart vertically oriented frame members on either side of the hoop which are positionable between the hoop and the vertical sides of the backboard and each having a pair of upper frame members and lower frame members, wherein each upper frame member comprises a holding means for removably mounting on the top side of the backboard, and wherein each lower frame member comprises a first horizontally oriented crossbar joining the lower frame members together below the hoop and a spaced apart second horizontally oriented crossbar vertically positioned between the first crossbar and the hoop, the second crossbar having spaced apart crossbar slots adjacent the lower frame members; (b) a trough mounted on or against the first crossbar so as to be cantilevered from the first crossbar with spaced apart parallel rails each having opposed proximal and distal ends along axis defined by the rails and connecting the rails together wherein the proximal end is adapted to be removably mounted on or against the first crossbar; (c) a pair of spaced apart panels mounted on opposite rails so that a portion of the panels adjacent to each rail extends below the axis of rail, wherein the basketball rides on the rails without riding on the portions of the panels adjacent to the rails so that the basketball is returned by the trough with a minimal rolling resistance to the ball; (d) a hook end defined at a top and proximal end of each panel, the hook end adapted to be removably mounted into each crossbar slot to form a generally syncline, V-configuration, of the pair of panels with the rails; and (e) an extender mounted at the distal end of the rails having a pair of deflector members each adapted to lie flat to allow for (i) direct ball delivery, or (ii) positioned substantially perpendicular to the axis of the rails for right side ball delivery or for left side ball delivery.

In a particular embodiment, the backboard has a front side for mounting the hoop and an opposite back side and wherein the spaced apart vertically oriented frame members are positioned either along the front side or along the back side of the backboard so as to substantially remove any obstruction from the front side of the backboard. In a further embodiment, the proximal end of the trough is adjacent the first crossbar and is mounted on a catch plate mounted on the first cross bar. The catch plate typically comprises a rectangular body defining a foot at a lower end for mounting the trough and an upper anchor plate adapted to be mounted on the first cross bar. In a further embodiment, the holding means comprises an extension perpendicular to the upper frame members defining a plurality of pin holes and an inverted J-hook for engaging the pin holes in various positions, whereby the backboard is positioned between the J-hook and the upper frame members. In an even further embodiment, a V-rod back stop having a pair of extending rod arms mounted between the first crossbar and the second cross bar, wherein the rod arms extend away from each other in a V-formation from the first cross bar to the second crossbar.

The extender can be adjustably connected to the rails to allow for various positioning of the extender with respect to the trough. In a particular embodiment, the extender comprises holding means for securing the extender to the rails and substantially preventing unintended removal of the extender during usage or carriage. Each deflector defines a proximal end and a distal end. Each deflector can be positioned substantially perpendicular to the axis of the rail at either the proximal or distal end. In a further embodiment, a reverse mounting belt or cord is attached to the lower frame member and lies over the hoop to provide additional structural support for the support assembly when the support assembly is mounted in reverse, back side of the backboard position.

In a particular embodiment, the panels are wires joined together to form each panel. In a further embodiment, some of the wires in the panels are parallel to the axis of the rails and are joined together by other vertically oriented wires which are connected to each of the rail means on an inside portion of the panel. The trough can be disconnected from the support assembly and folded flat for substantially compact carriage and storage. The extender is typically rounded at a distal end and angled down to provide the user with an ergonomically compatible grip for manual extension or retraction adjustment to deliver the ball straight to a user when the deflectors are lying flush and parallel with the rails or to the right or left side when the deflectors are positioned substantially perpendicular to the axis of the rails. The frame members can be adjustable so that the vertical position of the trough relative to the floor and hoop can be varied. Typically, the upper and lower frame members telescope into each other. Pin means, for securing the upper and lower frame members to each other, are adapted to pass through aligned holes defined in each of the frame members for adjusting the height of the lower frame members relative to the floor and hoop. In an even further embodiment, the holding means are adjustable so that the angle of the slope of the trough relative to the floor and hoop can be varied.

BRIEF DESCRIPTION OF THE DRAWINGS

FIGS. 3A-3B illustrate the mechanism for the deflector rotation with deflector in an up position.

FIG. 4A-4B illustrate the deflector in a down position.

FIG. 4C illustrates a cross section view of the deflector in a down position.

FIG. 5A illustrates an exemplary support assembly lying flat with the arms rotated towards each other for storage or carriage.

FIG. 5B illustrates a side view of an exemplary trough assembly folded substantially flat for storage or carriage.

FIG. 5C illustrates an exploded view of an exemplary trough assembly opened flat to show various components.

FIG. 5D illustrates an end view of an exemplary trough assembly rail.

DESCRIPTION OF PREFERRED EMBODIMENTS

Figures 1, 1A, 1B, 1C, 1D, 1E, 2, 2A, 2B:
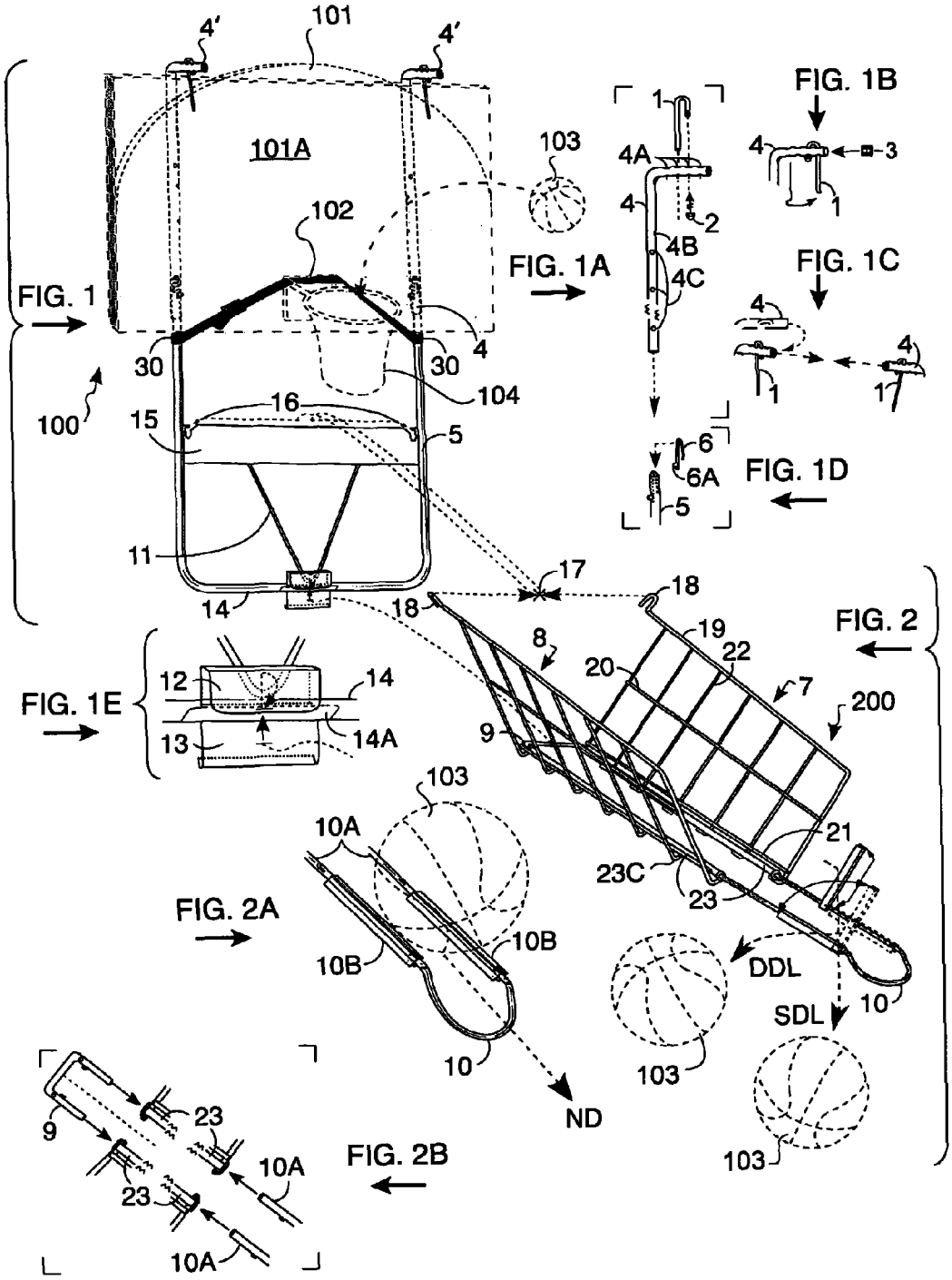
FIG. 1 illustrates an exemplary support assembly mounted on a backboard hoop assembly.
FIG. 1A illustrates an exploded view of an upper arm assembly with J-hook to mount over a backboard.
FIG. 1B illustrates a close up view of a mounting extension of the upper support arm with a J-hook mounted through the most distal mounting holes.
FIG. 1C illustrates rotating embodiments of the mounting extension with the J-hook for front or reverse side mounting on the backboard.
FIG. 1D illustrates an exemplary spring clip for mounting a lower arm into an upper arm.
FIG. 1E illustrates an exemplary catchplate for mounting onto the support assembly and receiving a trough assembly.
FIG. 2 illustrates an exemplary trough assembly for mounting onto the support assembly.
FIG. 2A illustrates an exemplary extender with deflectors mounted at the distal end of the trough assembly.
FIG. 2B illustrates the rail anchor portion at the proximal end of the trough assembly for connecting the rails and mounting onto the catchplate of the support assembly.

All patents, patent applications, government publications, government regulations, and literature references cited in this specification are hereby incorporated herein by reference in their entirety. In case of conflict, the present description, including definitions, will control.

U.S. Pat. No. 4,869,502 to Wares discloses a lightweight portable apparatus for retrieving a basketball herein incorporated by reference in its entirety.

As shown in FIGS. 1-1E, 2-2F, and 5A-5D, an exemplary basketball retriever apparatus comprises a support assembly 100 and a trough assembly 200, which can be made of metal, plastic, rubber, wood, or fiberglass. The support assembly 100 and trough 200 are adapted to mount on an exemplary backboard 101 and hoop 102 assembly. Backboard 101 defines a front face 101A and a reverse back side. In an exemplary embodiment, the upper part or upper end of support assembly 100 comprises a pair of identical upper arms or stanchions 4, also referred to and interchangeable with upper frame members 4, spaced apart and typically parallel with respect to each other. Upper arms 4 are generally vertically oriented and define a mounting section 4', typically constructed perpendicular to the main body of upper arm 4 for mounting over a backboard. Accordingly, arms 4 with mounting section 4' define substantially an inverted-L geometry.

Each arm 4 defines a plurality of lateral holes 4C at vertically spaced intervals passing respectively through arm 4. Holes 4C are sized and shaped to receive connection means such as bolts for securing the upper end (arms 4) of the support assembly 100 to the lower end (arms 5) of the support assembly 100. The lower part of support assembly 100, also shown in FIG. 1, comprises a lower U-frame 5, having a pair of rigid upwardly extending lower frame members 5, each having lateral holes near and through the top of each. In an exemplary embodiment, the connection means is a detent spring clip 6 as shown in FIG. 1D. Spring clip 6 is mounted in lower arm 5 of the lower section of the support assembly 100 and comprises a button 6A that engages holes 4C. Thus, lower arm 5 fits within the interior of upper arm 4 such that the button 6A of detent clip 6 can slide into arm 4 and lock into place at various vertical positions. The variously spaced apart holes 4C allow for varying the height of the trough 200 with respect to the hoop. Ventral or central holes 4B are positioned above holes 4C to allow more fully telescoping of lower arms 5 into upper arms 6, and to retain the connection of the arms while folded substantially flat for carriage or storage as shown in FIG. 5. In a particular embodiment, arms 5 are about 3½ feet (106.7 cm) long and are inserted and slidably positioned, as within a sleeve, in the openings of arms 4 in a range of height positions adjustable by means of aligning holes 4C with those of arm 5.

In an exemplary embodiment, arms 4 are about two feet (61 cm) long and have a substantially right angle bend at the top of each. Extending from the bend substantially perpendicular to arm 4 is a top mounting section 4' transversing a short horizontal distance on which is mounted a J-hook 1. Mounting section 4' defines a plurality of mounting holes 4A, also referred to as upper arm top thru-holes. Section 4' extends substantially perpendicular to arm 4, thus allowing the assembly 100 to be mounted on and over backboard 101. In a particular embodiment, the arms are mounted on the reverse side of backboard 101. This configuration substantially avoids placing obstructions in the space surrounding hoop 102, thus creating a more realistic shooting environment for the user.

Holes 4A are sized and shaped to receive an inverted J-hook 1. J-hook 1 functions as a bolt to secure the support assembly 100 to the backboard 101. In an exemplary embodiment, the longer leg of J-hook 1 passes through a hole 4A and the shorter leg passes through an adjacent hole 4A. The shorter leg of J-hook 1 is secured in place by a cap nut 2. The mounting of assembly 100 can be either on the front side or, as shown in FIG. 1, on the reverse side of backboard 101. FIGS. 1A and 1B illustrate the connection mechanism between section 4', J-hook 1, and cap nut 2. As shown in FIG. 1B, a tube end plug 3 can be used at the end of mounting section 4' of arm 4. The longer leg of J-hook 1 is positioned over backboard 101 such that backboard 101 is positioned between arm 4 and J-hook 1. Accordingly, J-hook 1 should be positioned in holes 4A such that support assembly 100 is securely mounted over backboard 101. The various holes 4A allow for adjusting to the appropriate thickness of backboard 101. The assembly 100 thus can be adapted to be mounted securely on variably sized backboards.

U-frame 5 bends into bottom rung 14 that connects each arm 5 together. Bottom run 14 serves as a first crossbar 14 for mounting trough assembly 200. In a particular embodiment, first crossbar 14 is a transverse span about 2 feet long (61 cm), so that the arms 5 are parallel to each other and perpendicular to rung 14. A V-rod backstop 11 is provided between first crossbar 14 and a second cross bar 15 positioned between arms 5 and vertically between first crossbar 14 and hoop 102. Arms 5 are connected to second crossbar 15. Crossbar 15 comprises horizontally spaced apart crossbar slots 16 positioned substantially adjacent arms 5. Crossbar slots 16 are sized and shaped to securely receive hook ends or mounting means 18 of trough assembly 200 for hanging trough assembly 200. Moreover, slots 16 are sized and shaped to assure suitable release of hook ends 18 from slots 16 when dismounting trough assembly 200 from support assembly 100.

In a particular embodiment, support assembly 100 is provided with additional support by a member selected from the group consisting of a cord, strap, belt, belts, and combinations thereof. In an exemplary embodiment, a pair of reverse mounting belts 30 are utilized as shown in FIG. 1. These belts hold lower arms 5 secure in a reverse backboard side mounting configuration of assembly 100. The belts 30 pass over hoop 102. The belts 30 substantially prevent unintended movement of assembly 100, particularly in a backward direction swinging away from the backboard 101. By adjusting the tension or length of belts 30, the belts 30 can be used to adjust the slope of the lower frame members 5 so that the angle of the slope of the trough assembly 200 relative to the floor and hoop 102 can be varied. Support assembly 100 together with trough assembly 200 may be much less likely to shake vigorously or otherwise rather than benignly flex as they are struck with the ball during use. In an exemplary embodiment, a single, moderately stretchable, cord, strap, or belt 30 can be used, or a plurality of substantially rigid, adjustable, mating belts 30 can be used.

Trough assembly 200 is shown in FIG. 2. In a particular embodiment, trough assembly 200 can be characterized as a modular assembly having modular components, such as panels 7 and 8, that can be assembled to perform essentially the same function. In the embodiment shown in the figures, trough assembly 200 comprises an extender 10 having deflectors 10B to adjust for various, including particular differently angled, directional ball delivery outcomes. In this embodiment, only a single extender 10 is needed to achieve the various desired ball 103 delivery outcomes. Multiple extenders are no longer needed to deliver the ball 103 to multiple locations. Trough 200 comprises a pair of synclinally facing, trapezoidally cross-sectioned, grid-like trough panels 7 (right panel) and 8 (left panel). Panels 7 and 8 are cantilevered from the support assembly 100 at a downwardly inclined angle with respect to hoop 102. In a particular embodiment, the panels 7 and 8 are about 3½ feet long (106.7 cm) and comprised of wires 19, 20, 21, and 22 of sufficient strength to be rigid to the impact of a basketball 103 striking the panels 7 and 8.

In a particular embodiment, the uppermost wires 19 of panels 7 and 8 include hook ends or hooks 18 that are adapted to engage second crossbar 15 via slots 16. Panels 7 and 8 rest against first crossbar 14. Panels 7 and 8 include a pair of ball runway tubes 23 that run substantially parallel with respect to each other. Vertical wires 22 are joined to the tubes 23 so that there are downwardly projecting portions 23C away from tubes 23 which in a particular embodiment are about 2 inches (5 cm) long. In this manner the ball 103 does not engage the wires 20 and 22 adjacent the tubes 23 thereby speeding the ball 103 towards the player. In a particular embodiment, the axis defined by tubes 23 is at an angle of about 15° to about 30° from a line perpendicular to the face 101A of backboard 101.

Rails 23 are joined together by an anchor 9 at a proximal end as shown in FIG. 2B. Anchor 9 is generally U-shaped and is adapted to be mounted on or against first cross bar 14 as shown in FIG. 1 and FIG. 2. A distal end anchor as a generally U-shaped trough extender 10 is defined at the opposite end with respect to anchor 9. Extender 10 also joins tubes 23 together. The anchor 9 and extender 10 form a two-fold hinge point between panels 7 and 8, and are held in place by insertion into right and left end openings in tubes 23 thereby preventing lateral movement and restraining tubes 23 in mutual, substantially parallel relationship.

Anchor 9 is typically received by a rear anchor catchplate 12. Catchplate 12 can also be referred to as a mounting bracket. As shown in FIG. 1E, catchplate 12 comprises a mounting foot 13 for receiving the proximal end anchor 9 of trough assembly 200. Typically, catchplate 12 has an upper substantially inverted hook or J-portion adapted to be mounted on and projecting out from atop the first crossbar 14. Typically, crossbar 14 defines a flat section 14A which is faced downward slightly with respect to an axis defined by the crossbar 14. In a particular embodiment, the tilt of flat section 14A is at an angle of between about 10° and 30°. Crossbar 14 is sized and shaped to receive catchplate 12. Behind catchplate 12 is also received the vertex of V-rod backstop 11. V-rod backstop 11 comprises a pair of legs that extend up and away from each other and connect to second crossbar 15. V-Rod backstop 11 can serve as a backstop for the ball 103 during use to ensure that ball 103 travels down trough assembly 200.

As shown in FIG. 2A, extender 10 is generally bent downward with respect to the axis defined by rails 23. This allows for the ball to drop off after running down the track defined by rails 23. Extender 10 converges to a rounded U-shape and bends in a particular embodiment at an angle of between about 25° and 45° and in a further embodiment of about 35°.

FIGS. 2, 2A, 2C, 2D, 2E, 2F, 3A-3B, and 4A-4C illustrate a particular aspect of the present disclosure directed to the deflector members. Trough assembly 200 comprises a pair of deflector members 10B mounted on legs 10A of track or rail extender 10 emerging from rails 23. Deflector members 10B are mounted at the distal end of rails 23, namely, on rail extender 10. The deflector members each define a substantially rectangular geometry having a channel for being mounted over legs 10A. Each deflector member can be positioned lying substantially flat and parallel with the axis of the rails 23 or rotated substantially perpendicular to the axis of the rails 23. In a particular embodiment as shown in the figures, rotating deflector 10B positions the channel of the deflector 10B facing upward towards the hoop. The point of rotation can be at either the distal end 10D or proximal end 10P defined on legs 10A of extender 10.

Figure 2C:
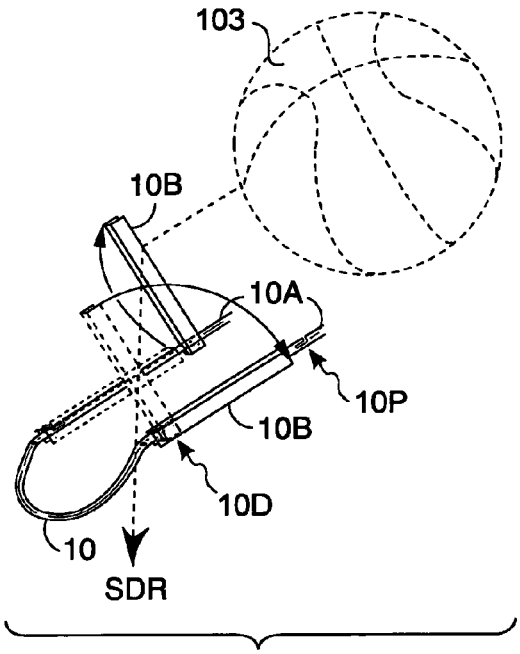
FIGS. 2C-2F illustrate various exemplary configurations of deflector members positioned up or down with respect to the extender rails.
Figure 2D:
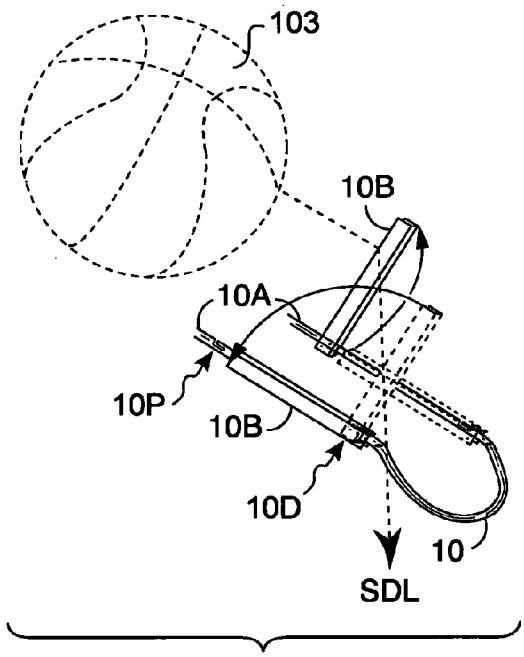
Figure 2E:
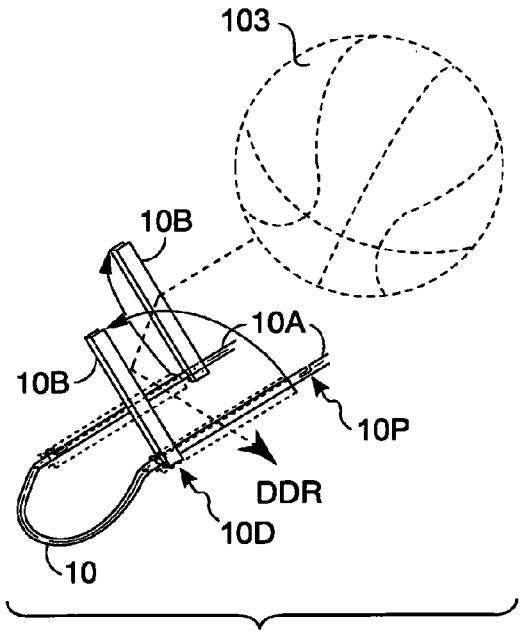
Figure 2F:
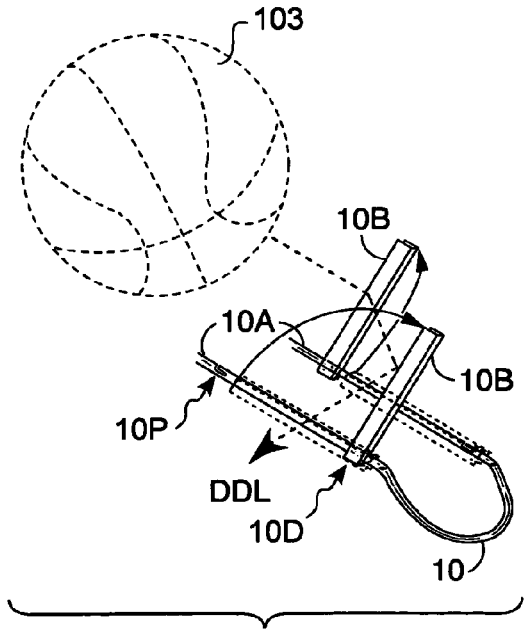

The deflectors 10B are adapted to provide a variety of ball 103 delivery positions as shown in FIGS. 2C, 2D, 2E, and 2F. FIG. 2C shows right side ball delivery with the left side deflector in an up position while the right side deflector 10B is in a down position. Deflectors 10B can be rotated upward to be substantially perpendicular to the axis of the rails 23. Typically, the deflectors 10B can be rotated to an up position that defines an angle between the deflector 10B and rail 23 of about 80° to 100°. Deflector 10B on the left side is positioned up at the proximal end 10P. In this embodiment, ball 103 will run into the left side deflector member 10B as it rolls down rails 23. This will deflect ball 103 to the right for right side ball delivery. The user can stand generally to the right of the hoop and have the ball returned to him or her using this orientation of the deflectors 10B. The opposite configuration is shown in FIG. 2D with the right side deflector 10B positioned up at the proximal end 10P with respect to rail 23 and the left side deflector 10B positioned down. FIGS. 2E and 2F show exemplary embodiments wherein each deflector is positioned upward, but with one deflector rotated at the proximal end 10P and the other at the distal end 10D. The arrows illustrate trajection of the ball in various directions resulting from the different positions of the deflector members. In the dual deflector-up embodiments shown in FIGS. 2E and 2F, the user can stand at a different side position on a playing surface for a variety of shooting distances as compared to the single deflector 10B embodiment shown in FIGS. 2C and 2D.

FIGS. 3A, 3B, 4A-4C illustrate the mechanism for the mounting and rotation of deflector members 10B with respect to legs 10A of extender 10. Each deflector 10B can rotate upward with respect to the axis of the rails 23 at a proximal end 10P or distal end 10D of legs 10A of extension 10. In particular embodiments as shown in the figures, deflector 10B rotates up such that the channel for receiving leg 10A is facing substantially upward towards the support assembly 100. Proximal end 10P and distal end 10D can also be referred to as points of rotation. Orientation slots 27 are defined in each of legs 10A to allow for rotation at either proximal 10P or distal end 10D. Each leg 10A defines at least one slot 27. In a particular embodiment, each leg 10A defines a pair of spaced apart slots 27 at a proximal end 10P and distal end 10D of leg 10A to allow for multiple points of rotation of deflector 10B. In an even further embodiment, leg 10A defines a plurality of slots 27 to allow for multiple positions for deflectors 10B. Each deflector 10B comprises at least one orientation pin 28 at one end of the deflector 10B and extending the span of the channel from one internal wall of deflector 10B to the other as shown in cross section view FIG. 4C. Deflector 10B can be positioned into slots 27 via pin 28 and can move from one slot to another. Slot 27 can define a substantially right angle configuration with a slot extending along the axis of rails 23 and an opening perpendicular to the axis of rails 23 as shown in FIGS. 3A, 3B, 4A, and 4B. The deflector defines a U-shaped foramen 10E at one end of the deflector 10B. Foramen 10E allows for rotation of deflector 10B such that leg 10A passes partially through foramen 10E so deflector 10B can stand substantially vertical with respect to the axis of rails 23 and having the channel facing the support assembly 100.

Each deflector 10B comprises at least one orientation pin 28 at one end of the deflector 10B and extending the span of the channel from one external wall of deflector 10B to the other as shown in cross section view FIG. 4C. Deflector 10B can be positioned into slots 27 via pin 28 and can move from one slot to another. Slot 27 can define a substantially right angle configuration with a slot extending along the axis of rails 23 and an opening perpendicular to the axis of rails 23 as shown in FIGS. 3A, 3B, 4A, and 4B. The deflector defines a U-shaped foramen 10E at one end of the deflector 10B. Foramen 10E allows for rotation of deflector 10B such that leg 10A passes partially through foramen 10E so deflector 10B can stand substantially vertical with respect to the axis of rails 23 and having the channel facing the support assembly 100.

FIG. 4C illustrates a cross section view to show the relationship of pin 28 with respect to deflector 10B and leg 10A. Pin 28 can slide into slot 27 located at either proximal end 10P or distal end 10D. Once the user decides which end location is the point of rotation, pin 28 slides into slot 27 to rotate deflector 10B either upward or back downward. FIG. 4A illustrates an exemplary embodiment where deflector 10B is rotated downward about pin 28 at the distal end 10D from an up position.

In a further embodiment, an optional capture pin 29 is utilized. Capture pin 29 functions to hold deflector 10B in place, whether or not 10B is in either a down or up configuration. Pin 29 is movable and prevents unintended removal of deflector 10B. Typically, deflector 10B is positioned such that leg 10A is between pin 29 and deflector 10B. Pin 29 is shown in FIG. 3B positioned underneath leg 10A thus preventing deflector 10B from being unintentionally removed. Pin 29 is easily moved along the axis of rails 23 when adjusting the positioning of deflector 10B within the various slots 27. In a further embodiment, pin 29 is removable.

Pin 29 is suitable for capturing deflector 10B, after deflector 10B has been movably mounted on the extender 10, to substantially prevent deflector 10B from detachment during operation or carriage. If, as a result of gravity or vibration, pin 28 comes to be dislodged from slot 27, potentially resulting in unintentional deflector 10B detachment during operation or carriage, then pin 29 is provided for substantially preventing such unintentional deflector 10B detachment. Pin 29 further prevents unintentional deflector 10B detachment by the user.

The mechanism of pin 29 is to substantially restrict the user in manually positioning a deflector 10B so as to allow only slightly movable detachment of the deflector 10B. Accordingly, sliding pin 28 slightly out from slot 27, allows for sliding deflector 10B along the axis of rails 23 for adjusting the point of rotation from the proximal end 10P to the distal end 10D and vice versa. In a further embodiment not depicted in the drawing, rather than making a right, substantially 90° bend, slot 27 can be defined at an angle downward off the horizontal, at about 20 degrees; to allow for the user to moveably detach and slide a deflector 10B along the axis of the rails 23, either forward or backward, until it slides into a proximal or distal slot 27 of the extender 10. A deflector 10B can further define a location of pin 29 as spanning the deflector 10B width in a manner so as to be located sufficiently below the extender 10 when mounted as to allow for movably detaching a deflector 10B when positioning it. The location of pin 29 defines a deflector that can be adjustably moved so as to position pin 28 in either a proximal or a distal extender slot 27 and adjustably be positioned either to lie flat or to stand substantially perpendicular to the axis of the rails 23 without removing pin 29.

FIGS. 3A, 3B, and 4A-4C illustrate capture pin 29 spanning across a [U-channel] deflector 10B from one leg of a [U-channel] deflector 10B thru the other leg (as shown in the cross section, FIG. 4C) and extending across and beneath the bottom of a leg, 10A, of the track extender 10 with enough space provided between the top of pin 29 and the bottom of extender leg 10A so as to allow the movable detachment of deflector 10B when sliding it slightly up and out of slot 27.

FIGS. 5B-5D illustrate an exemplary trough assembly 200. FIG. 5B shows a side view of trough assembly 200 folded substantially flat for carriage or storage. FIG. 5C illustrates an exploded view of an exemplary trough assembly 200 to show individual components of trough assembly 200. Trough assembly 200 comprises a pair of spaced apart substantially parallel rails 23 defining generally parallel longitudinal axis. Trough panels 7 and 8 are connected to the rails along the longitudinal axis and are adapted to rotate along with rails 23 about anchor 9 and extender 10. In a particular embodiment, panels 7 and 8 each comprise wires extending the length of the panel and substantially parallel with the axis defined by the rails. These wires comprise a lower wire 21, a middle wire 20, and a top wire 19. Vertical wires 22 intersect wires 19, 20, and 21 in a substantially perpendicular configuration and are spaced apart along the length of the panels 7 and 8.

FIGS. 5C-5D illustrate a particular aspect of the present disclosure directed to the holding and connection mechanisms for rails 23, anchor 9, and extender 10. Anchor 9 holds the rails 23 together at a proximal end of the rails. In a particular embodiment, not depicted in the drawings, slightly flattening a proximal end of a tube rail 23, wherein the flat area extends out to a point about one inch from the end, can define a generally oval shaped tube end profile. Each leg of U-shaped anchor 9 can be flattened so as to cause particular ridge areas to be raised as pins or flanges, defining butterfly projections 25. These flange detente points 25 at about one inch proximal to the elbows of U-anchor 9 can be defined for mutual engagement, wherein the anchor 9 and rails 23 can be mutually engaged so as to enable a connection unintended pullout stop when oriented for usage, carriage or storage.

At an opposite distal end of rails 23, a similar holding and connection mechanism can be utilized for extender 10, wherein a butterfly projection 25 is located at a point about 3½ inches from the ends of legs 10A along the longitudinal axis of extender 10. In a particular embodiment, slotted washers 24 can be used to facilitate connection of anchor 9 and rails 23. A pin, flange, or a butterfly projection 25 can be utilized to hold anchor 9 in rails 23. At an opposite distal end of rails 23, a similar holding and connection mechanism can be utilized for extender 10. Legs 10A can be connected to rails 23 through washers 24 and held in rails 23 by pins, flanges, or butterfly projections 25. FIG. 5D illustrates an end view of rail 23 with a washer 24 in place. In a particular embodiment, washer 24 defines a keying slot or recess 24' for receipt of a pin, flange, or butterfly projection 25 on legs 10A. In an even further embodiment, a ball pin stop 26 is positioned in anchor 9 to stop full insertion into rails 23 in order to enable a butterfly projection 25 to properly engage washer 24 as a pullout stop. Ball pin stop 26 is intended to stop full insertion of anchor 9 into rails 23 to enable the butterfly projection 25 to be properly engaged as a pullout stop by fixing the proper positioning of the flange point relative to the rail end.

The trough assembly 200 panels 7 and 8 can be folded together, rotating uppermost wires 19 including hooks 18 until they generally meet as shown in FIG. 2 at point 17 so that panels 7 and 8 are relatively aligned and sandwiched together to form a generally alpine, A-configuration, ready for mounting on support assembly 100. Once hooks 18 are positioned over crossbar 15, the panels can be spread apart to easily slide away from each other and along crossbar 15 until the hooks naturally engage slots 16. This provides for easy and convenient setup and mounting of trough assembly 200 with respect to support assembly 100.

As shown in FIG. 1, support assembly 100 is provided with adaptable suspensory means, so as to enable it to be demountably suspended from the top edge of a variously sized conventional basketball backboard 101, and provides means for suspending and supporting the modular trough assembly 200 in position.

The user begins by selecting a goal assembly, including a backboard 101, hoop 102, and net 104, for which he intends to use the basketball retriever. The position of J-hooks 1 is adjusted to accommodate the thickness of the backboard 101 including any thickness added by the goal support assembly to which the backboard is mounted. In a particular embodiment, the J-hooks 1 are adjusted to accommodate the thickness of the backboard 101 including any thickness up to four inches added by the goal support assembly to which the backboard is mounted. This is accomplished by selecting a pair of specific holes 4A in which to insert J-hook 1 so as to be spaced an appropriate distance over backboard 101.

Next, the user adjusts the height of the support assembly 100 to accommodate the specific vertical dimension of the particular backboard 101 of the goal assembly he has selected to use. This is accomplished by selecting the appropriate holes 4C to align lateral holes in lower arms 5 for receiving detent spring clip 6 into holes 4C. The adjustment is made to meet the proper height to enable crossbar 15 to be positioned several inches or more below the hoop 102 and net 104.

The user hoists up and then lowers support assembly 100 to mount it on the top edge of the backboard 101. This is accomplished by slipping the backboard 101 into the gap between the longer leg of J-hook 1 and upper arm 4. Smaller players may utilize the aid of a ladder or a lifting tool. The modular trough assembly 200 has the hooks 18 as suspensory means for depending from support assembly 100 in position below the hoop 102 and has extender 10 for extending the redepositing of a basketball 103 to a player.

Nested for transportation, trough assembly 200 is in its flat, telescopically compressed position. Unfolding trough assembly 200 from its collapsed position, the user rotates trough panels 7 and 8 about rails 23 until they are configured to form a trough shape with rails 23 forming a substantially parallel track. The user can also mount hooks 18 substantially side-by-side on crossbar 15 at point 17 and then spread the panels 7 and 8 out until they reach slots 16.

Panels 7 and 8 operate as rigid ball collection means and function to guide the ball 103, including a missed shot entering said means extending in front of the goal, onto rails 23, also referred to as runway tubes 23.

Users should select the extender deflector module 10 and adjust its length by sliding it in or out of rails 23 in accordance with the degree of extension desired in order to maintain the setting event of the ball 103 returning to the hands comfortably and efficiently with speed and vigor. The user pushes the extender 10 in towards the backboard 101 for practicing the rhythm of closer shots and out for practicing the rhythm of more distant shots.

The ball retriever according to the present disclosure operates in a manner characterized in that the hoop 102 and net 104 of the goal assembly on which it is mounted have freedom from any and all encumbrances of the retriever, thereby ensuring that the hoop 102 and net 104 are free to respond normally to the impact of the ball 101 and presenting, for and during optimal use of the retriever apparatus, a substantially clear viewing path to the hoop 102 and net 104 from locations on-court circumscribed by a 180° arc in front of the backboard 101.

By pushing extender 10 into rails 23 to its minimum extension and demounting, practicing backward the steps of mounting, trough assembly 200 can be readily unhooked from support assembly 100 and further easily collapsed by insuring that anchor 9 is pushed inward of rails 23 and by folding trough panels 7 and 8 to be flat and nested against each other. Support assembly 100 likewise has collapsibility and foldability. After demounting from the backboard 101, support assembly 100 can be collapsed by pressing in on spring clip 6 and rotating the arms 4 to lie flat within the plane of crossbar 15 and telescoping arms 5 into arms 4 to their minimum extension, that is, until buttons 6A of spring clips 6 engage ventral holes 4B of arms 4. Collapsibility and foldability facilitate easy handling, transport, and storage.

The improved design of the invention provides the advantage of flexibility of utility as a hand portable storage/carriage device. If trough assembly 200 is configured in unfolded syncline position as a bin, by flipping over extender 10 and reinserting it in a downside-up position, several basketballs can be retained for storage or carriage.

While the present invention is described herein with reference to illustrated embodiments, it should be understood that the invention is not limited hereto. Those having ordinary skill in the art and access to the teachings herein will recognize additional modifications and embodiments within the scope thereof. Therefore, the present invention is limited only by the claims attached herein.

What is claimed is:

1. An apparatus for mounting onto a support for use in retrieving a basketball passing through or shot at a hoop, which apparatus comprises:

(a) a trough assembly comprised of a pair of spaced apart rails defining a proximal end for mounting on a support means and a distal end for ball delivery to a user, wherein the trough assembly is mounted to be angled substantially downward from the proximal end to the distal end to allow the ball to roll down the rails;

(b) an extender mounted at the distal end of the rails having a pair of legs defining a proximal end and a distal end; and (c) a pair of deflector members, one mounted on each leg of the extender, wherein each deflector member is adapted to lie flat for direct ball delivery or rotate upward, at either the proximal end or distal end of the extender, to be positioned substantially perpendicular to the rails.

2. The apparatus of claim 1 wherein each leg of the extender defines at least one slot for receiving a deflector to allow for rotation upward of the deflector about the slot.

3. The apparatus of claim 2 wherein each deflector comprises an orientation pin that slides into the slot for rotation about the slot.

4. The apparatus of claim 3 wherein each leg of the extender defines a plurality of slots.

5. An apparatus for retrieving a basketball after it passes through or is shot at a hoop mounted on a backboard having a top side, an opposed bottom side, and vertical sides between the top side and the bottom side, which apparatus comprises:

(a) a support assembly comprised of (i) a holding means for removably mounting on the top side of the backboard, (ii) a first horizontally oriented crossbar below the hoop, and (iii) a spaced apart second horizontally oriented crossbar vertically positioned between the first crossbar and the hoop;

(b) a trough mounted on or against the first crossbar so as to be cantilevered from the first crossbar, the trough comprising spaced apart parallel rails each having opposed proximal and distal ends along an axis defined by the rails and connecting the rails together wherein the proximal end is adapted to be removably mounted on or against the first crossbar;

(c) a pair of spaced apart panels having proximal and distal ends mounted on opposite rails so that a portion of the panels adjacent to each rail extends below the axis of the rails, wherein the basketball rides on the rails without riding on the portions of the panels adjacent to the rails so that the basketball is returned by the trough with a minimal rolling resistance to the ball;

(d) mounting means on the proximal end of each panel for removably mounting the panels on the second crossbar to form a generally syncline, V-configuration, of the pair of panels with the rail; and (e) an extender mounted at the distal end of the rails having a pair of deflector members adapted to lie flat to allow for (i) direct ball delivery, or (ii) positioned substantially perpendicular to the axis of the rails for right side ball delivery, or for left side ball delivery.

6. An apparatus for retrieving a basketball after it passes through or is shot at a hoop mounted on a backboard having a top side, an opposed bottom side, and vertical sides between the top side and the bottom side, which apparatus comprises:

(a) a support assembly comprised of a pair of spaced apart vertically oriented frame members on either side of the hoop which are positionable between the hoop and the vertical sides of the backboard and each having a pair of upper frame members and lower frame members, wherein each upper frame member comprises a holding means for removably mounting on the top side of the backboard, and wherein each lower frame member comprises a first horizontally oriented crossbar joining the lower frame members together below the hoop and a spaced apart second horizontally oriented crossbar vertically positioned between the first crossbar and the hoop, the second crossbar having spaced apart crossbar slots adjacent the lower frame members;

(b) a trough mounted on or against the first crossbar so as to be cantilevered from the first crossbar with spaced apart parallel rails each having opposed proximal and distal ends along an axis defined by the rails and connecting the rails together wherein the proximal end is adapted to be removably mounted on or against the first crossbar;

(c) a pair of spaced apart panels mounted on opposite rails so that a portion of the panels adjacent to each rail extends below the axis of the rails, wherein the basketball rides on the rails without riding on the portions of the panels adjacent to the rails so that the basketball is returned by the trough with a minimal rolling resistance to the ball;

(d) a hook end defined at a top and proximal end of each panel, the hook end adapted to be removably mounted into each crossbar slot to form a generally syncline, V-configuration, of the pair of panels with the rails; and (e) an extender mounted at the distal end of the rails having a pair of deflector members each adapted to lie flat to allow for (i) direct ball delivery, or (ii) positioned substantially perpendicular to the axis of the rails for right side ball delivery or for left side ball delivery.

7. The apparatus of claim 6 wherein the backboard has a front side for mounting the hoop and an opposite back side and wherein the spaced apart vertically oriented upper frame members are positioned along the back side of the backboard so as to substantially remove any obstruction from the front side of the backboard.

8. The apparatus of claim 6 wherein the proximal end of the trough is adjacent the first crossbar and is mounted on a catch plate mounted on the first cross bar.

9. The apparatus of claim 8 wherein the catch plate comprises a rectangular body defining a foot at a lower end for mounting the trough and an upper anchor plate adapted to be mounted on the first cross bar.

10. The apparatus of claim 6 wherein the holding means comprises an extension perpendicular to the upper frame members defining a plurality of pin holes and an inverted J-hook for engaging the pin holes in various positions, whereby the backboard is positioned between the J-hook and the upper frame members.

11. The apparatus of claim 6 further comprising a V-rod back stop having a pair of extending rod arms mounted between the first crossbar and the second cross bar, wherein the rod arms extend away from each other in a V-formation from the first cross bar to the second crossbar.

12. The apparatus of claim 6 wherein the extender is adjustably connected to the rails to allow for various positioning of the extender with respect to the trough.

13. The apparatus of claim 12 wherein the extender comprises a holding means for securing the extender to the rails and substantially preventing unintended removal of the extender during usage or carriage.

14. The apparatus of claim 6 wherein each deflector defines a proximal end and a distal end and each deflector can be positioned substantially perpendicular to the axis of the rail at either the proximal or distal end.

15. The apparatus of claim 6 further comprising a reverse mounting belt attached to the lower frame members and lying over the hoop to provide additional structural support for the support assembly when the support assembly is mounted in a reverse, back side of the backboard position.

16. The apparatus of claim 6 wherein the panels are wires joined together to form each panel.

17. The apparatus of claim 16 wherein some of the wires in the panels are parallel to the axis of the rails and are joined together by other vertically oriented wires which are connected to each of the rail means on an inside portion of the panel.

18. The apparatus of claim 6 wherein the trough can be disconnected from the support assembly and folded flat for substantially compact carriage and storage.

19. The apparatus of claim 6 wherein the extender is rounded at a distal end and angled down to provide the user with an ergonomically compatible grip for manual extension or retraction adjustment to deliver the ball straight to a user when the deflectors are lying flush and parallel with the rails or to the right or left side when the deflectors are positioned substantially perpendicular to the axis of the rails.

20. The apparatus of claim 6 wherein the frame members are adjustable so that the vertical position of the trough relative to the floor and hoop can be varied.

21. The apparatus of claim 6 wherein the upper and lower frame members telescope into each other and pin means for securing the upper and lower frame members to each other, is adapted to pass through aligned holes defined in each of the frame members for adjusting the height of the lower frame members relative to the floor and hoop.

22. The apparatus of claim 6 wherein the holding means are adjustable so that the angle of the slope of the trough relative to the floor and hoop can be varied.

* * * * *